United States Patent [19]

Asano et al.

[11] 4,027,070

[45] May 31, 1977

[54] STEEL PLATE FOR PREPARING CANS BY IRONING

[75] Inventors: Hidejiro Asano; Shigeyoshi Maeda, both of Kitakyushu, Japan

[73] Assignee: Nippon Steel Corporation, Tokyo, Japan

[22] Filed: Mar. 5, 1975

[21] Appl. No.: 555,552

[30] Foreign Application Priority Data

Mar. 8, 1974 Japan ..... 49-26191

[52] U.S. Cl. ..... 428/341; 428/461; 428/463; 428/467; 428/497; 428/469; 148/6.15 R; 148/6.15 Z; 427/409; 427/417; 427/418; 427/419 G

[51] Int. Cl.[2] ..... B32B 15/08; B32B 15/18

[58] Field of Search ..... 428/467, 341, 461, 469, 428/497, 457, 463; 252/59, 56 R; 427/409, 419 G, 418, 417; 148/6.15 R, 6.15 Z

[56] References Cited

UNITED STATES PATENTS

| | | | |
|---|---|---|---|
| 1,273,358 | 7/1918 | Gravell | 428/469 |
| 2,274,673 | 3/1942 | Earle | 252/56 R |
| 2,281,676 | 5/1942 | Cook | 252/56 R |
| 2,389,227 | 11/1945 | Wright | 252/56 R |
| 2,486,493 | 11/1949 | Revukas | 252/56 R |
| 2,516,914 | 8/1950 | Revukas | 252/56 R |
| 2,767,111 | 10/1956 | Otto | 148/6.15 R |
| 2,880,188 | 3/1959 | McKay | 428/467 |
| 3,298,954 | 1/1967 | Brown | 252/59 |
| 3,340,194 | 9/1967 | Rue | 252/59 |
| 3,454,495 | 7/1969 | Schneider | 252/59 |
| 3,480,485 | 11/1969 | Hart | 428/461 |
| 3,838,049 | 9/1974 | Souillard | 252/59 |
| 3,884,820 | 5/1975 | Miller | 252/59 |
| 3,941,910 | 3/1976 | Asano | 428/497 |

FOREIGN PATENTS OR APPLICATIONS

| | | | |
|---|---|---|---|
| 767,002 | 1/1957 | United Kingdom | 252/59 R |
| 710,109 | 6/1954 | United Kingdom | 252/59 R |

*Primary Examiner*—Ellis Robinson
*Attorney, Agent, or Firm*—Toren, McGeady and Stanger

[57] ABSTRACT

A steel plate for preparing cans by ironing having on its surface a composite oil coating which comprises a base oil and one or more, each amounting to 3 to 50 parts, selective from the group comprising of polybutene, polypropylene, polyethylene and ethyl or methyl polymethacrylate, the average molecular weight for each being in the range 500 to 30,000.

5 Claims, No Drawings

STEEL PLATE FOR PREPARING CANS BY IRONING

The present invention relates to a steel plate coated with a lubricant and having excellent ironing workability properties.

The ironing process for making cup-shaped cans comprises drawing a steel plate into cups with an appropriate combination of punch and dice, and then reducing the thickness of side wall of the cups by ironing with another combination of punch and dice between which the clearance is smaller than the thickness of side wall of the cups (being usually the same to or slightly thicker than that of the original plate). Forming by ironing is nowadays applied to aluminum plates and tin-plated steel plates. The ironing of these metals can be carried out easily using ordinary lubricant oils such as machinery oil, because aluminum is a soft metal and the tin on tin-plated steel plates works as a lubricant.

On the other hand, direct ironing of a steel plate using ordinary lubricating oils does not give satisfactory result, because (1) the critical ironing rate ( $(t_o - t_f)/t_o$, where $t_o$ is the thickness of the original plate and $t_f$ is the thickness of the wall when it is broken) of the steel is smaller than those of aluminum and tin-plated steel and (2) a scratch or a gash is often formed on the surface. The ironing process is different in the mechanism of lubrication from drawing and stretching processes, but rather it more closely resembles a severe rolling process. The fact that the surface of a metal to be treated in the ironing process is subjected to more severe friction than in the drawing or stretching process is apparent from a smooth and lustrous surface that is produced by ironing using a machine oil, while the lusterless surface is produced by drawing or stretching.

Therefore, if an ordinary lubricating oil is used in the ironing process, some materials are burnt and the powders thus produced accumulate on the tool and may, during continuous ironing, cause scratching or gashing to occur on the surface of products. This is a more serious problem than workability when a steel plate is subjected to direct ironing processing.

Since the scratching or gashing is produced by the direct contact (or friction) of the material with the tool, it can easily be avoided by the presence of an intervening lubricating layer or, in other words, by lubricating with an appropriate liquid. For example, the presence of polyacrylic ester, polyethylene, polybutene or polyvinyl alcohol, or a soap type solid lubricating agent in the form of a coating film that exist on the surface of a steel plate are effective to avoid direct contact of the surface with the tool and hence effective to prevent scratching or gashing. However, there still remain some defects of such treatment in that the cans produced by ironing a steel plate on which one of the above mentioned lubricating agents have been applied have (1) a lusterless dull surface that results in inferior decoration effect when printed, (2) a small critical ironing rate as compared with those of aluminum and tin-plated steel, and (3) excessive lubricating agent is difficult to remove at the end of the processing.

Previously no investigation has been made for a lubricating agent that provides luster to a material to be treated and also prevents scratching, for a special working treatment, such as, ironing.

The present invention has been attempted from the technical point of view that only a critical state of lubrication can be used which can be realized immediately before a perfectly liquid lubrication is reached, to attain the most adequate state of lubrication useful to avoid scratching or gashing on the surface of products and to produce a lustrous beautiful surface. Thus, the present inventors have found that the above requirements can be satisfied with use of those lubricating oils which are produced from organic high molecular coumpounds, such as, polybutene, polypropylene, polyisobutylene and polyacrylic ester by diluting them with a mineral oil, such as, machine oil or an animal or vegetable oil, such as, tallow oil and palm oil, where these oils are mixed, if necessary, with saturated or unsaturated monocarboxylic acids, such as, lauric, stearic, palmitic and oleic acids. These lubricating oils are liquid or semi-solid at room temperature, depending on the amount and the average molecular weight of the high molecular substances added, and they are readily degreased by spraying a suitable commerically available degreasing agent. To increase the degreasing efficiency, if necessary, mono- or diglyceride of an aliphatic carboxylic acid or a commercial ionic or nonionic surfactant is added beforehand. It is known to add an organic high molecular substance to a lubricating oil, but this known art has the purpose of only avoiding a decrease of viscosity at a high temperature, and is based on an entirely different technical thought from that of this present invention which intends not only to prevent scratching or gashing in the ironing processing, but also to provide a lustrous surface of products.

Further, the critical ironing rate can be made larger without sacrificing the surface appearance, if the steel plate to be treated is coated beforehand with phosphate of zinc, manganese or iron in a thickness of 0.2 to 10 $mg/dm^2$ before the above mentioned lubricating oils containing diluted high molecular substances is applied. If the amount of the phosphate applied exceeds the upper limit, the surface luster will be deteriorated after the processing.

The optinum concentration of the high molecular substances to be added depends on type of material and the average molecular weight. If the average molecular weight is smaller than 500, the high molecular weight substance added even in amounts exceeding 50% to a base oil (mineral, animal or vegetable), can produce a good lubrication condition. But such a high concentration is undesirable because the increased viscosity makes the the handling and degreasing procedure difficult. Substances of higher molecular weights need a smaller amount to exhibit the effect. For instance, polypropylene of an average molecular weight 10,000 to 15,000 shows the highest effect when added in an amount of 20 to 30% (against tallow or spindle oil). For a smaller molecular weight substance, a higher concentration, say 50%, will suffice to improve the lubrication. These exist three isomers of polypropylene, isotactic, syndiotactic and atactic, having the stero regularity different from each other. Among them, atactic polypropylene having the side methyl groups oriented randomly is the most suited since it gives the best lubrication and viscosity that is favorable to handling. Aliphatic carboxylic acids, saturated or unsaturated, such as lauric, stearic, palmitic, oleic and linoleic acids, though they are contained more or less in tallow in the form of free acid, is effective in improving the lubrication (in reducing scratching and improving the processing) by adding several per cent to the diluted oils mentioned above. The adequate concentration is 20% at the highest, because the effect will be saturated at a higher concentration.

Examples of the present invention will be described hereinunder.

EXAMPLE 1

A lubricating oil consisting of 70 parts of tallow (extra fancy class), 20 parts of polypropylene (atactic, molecular weight 12,000) and 10 parts of lauric acid was applied to the thickness of 5mg/dm²A 0.35 mm thick steel plate (tin-plated, 1-grade tempered) was subjected to ironing with an ironing rate of 50%. More than 100 cans were produced successively. Every can had a beautiful lustrous appearance without forming a scratch. For comparison, machine oil was applied to the same kind of material, when the appearance was beautiful and lustrous, but a scratch was formed from the third can and after and many gashes were observed from the fifth or eighth can and onward.

EXAMPLE 2

A lubricating oil consisting of 80 parts of tallow, 10 parts of methyl polymethacrylate with the average molecular weight 28,000, 7 parts of stearic acid and 3 parts of monoglyceride of stearic acid was applied to the surface of a steel plate to the amount of 5mg/dm². The steel plate thus treated was processed by ironing with an ironing rate of 50%. No scratching nor gashing occurred when more than 100 cans were produced successively. Appearance was good and beautiful.

EXAMPLE 3

A lubricating oil consisting of 60 parts of No. 60 spindle oil, 30 parts of polybutene (average molecular weight 2,100), 7 parts of oleic acid, and 3 parts of polyethyleneglycol oleyl ester was applied to a steel plate, which was then processed by ironing with the ironing rate 50%. When more than 100 products were manufactured successively, no scratching was observed, appearance was lustrous and degreasing property was good enough.

EXAMPLE 4

A lubricating oil consisting of 70 parts of palm oil, and 30 parts of polypropylene (atactic, molecular weight 5,600) was applied to a steel plate, from which more than 100 cans were produced successively with the ironing rate 50%. No scratching and beautiful appearance were observed.

EXAMPLE 5

A lubricating oil consisting of 70 parts of tallow, 20 parts of polypropylene and 10 parts of lauric acid was applied to a steel plate which had been subjected to a zinc phosphate treatment so as to be covered with a coating of 1 mg/dm² and then processed by ironing.

No crack was observed even at an ironing rate of 70 %, while a steel plate which was not treated with zinc phosphate made a crack at an ironing rate of 60%. However, both kinds of products showed no scratch nor gash and had good lustrous appearance.

What is claimed is:

1. A steel plate for preparing cans by ironing having on its surface a composite oil coating in an amount effective to avoid scratching or gashing of said steel plate surface consisting essentially of mineral oil and 3 to 50 parts of polyethylene having an average molecular weight from 500 to 30,000 and wherein the steel plate has on its surface under said composite oil layer, a layer of 0.2 to $10_{mg/dm}2$ thickness of a substance selected from a group consisting of zinc phosphate, manganese phosphate, and iron phosphate.

2. A steel plate for preparing cans by ironing having on its surface a composite oil coating in an amount effective to avoid scratching or gashing of said steel plate surface consisting essentially of mineral oil and 3 to 50 parts of ethyl or methyl polymethacrylate having an average molecular weight from 500 to 30,000.

3. A steel plate for preparing cans by ironing having on its surface a composite oil coating in an amount effective to avoid scratching or gashing of said steel plate surface consisting essentially of mineral oil and 3 to 50 parts of ethyl or methyl polymethacrylate having an average molecular weight from 500 to 30,000, and wherein the steel plate has on its surface under said composite oil layer, a layer of 0.2 to 10 $_{mg/dm}2$ thickness of a substance selected from a group consisting of zinc phosphate, manganese phosphate, and iron phosphate.

4. A steel plate for preparing cans by ironing having on its surface a composite oil coating in an amount effective to avoid scratching or gashing of said steel plate surface consisting essentially of mineral oil and 3 to 50 parts of ethyl or methyl polymethacrylate having an average molecular weight from 500 to 30,000, and wherein the composite oil coating further comprises 2 to 20% of a branched chain monocarboxylic acid having 10 to 18 carbon atoms per molecule.

5. A steel plate for preparing cans by ironing having on its surface a composite oil coating in an amount effective to avoid scratching or gashing of said steel plate surface consisting essentially of mineral oil and 3 to 50 parts of polyethylene having an average molecular weight from 500 to 30,000, and wherein the composite oil coating further comprises 2 to 20% of a branched chain monocarboxylic acid having 10 to 18 carbon atoms per molecule.

* * * * *